US009457248B2

(12) United States Patent
Long et al.

(10) Patent No.: US 9,457,248 B2
(45) Date of Patent: Oct. 4, 2016

(54) REMOVABLE, ROTATABLE GRIP ELEMENT FOR A BALL BAT OR OTHER SPORTING-GOOD IMPLEMENT

(71) Applicant: EASTON BASEBALL / SOFTBALL INC., Van Nuys, CA (US)

(72) Inventors: Keenan Long, Sherman Oaks, CA (US); Ian Montgomery, Simi Valley, CA (US)

(73) Assignee: EASTON BASEBALL/SOFTBALL INC., Thousand Oaks, CA (US)

( * ) Notice: Subject to any disclaimer, the term of this patent is extended or adjusted under 35 U.S.C. 154(b) by 0 days.

(21) Appl. No.: 14/313,186

(22) Filed: Jun. 24, 2014

(65) Prior Publication Data

US 2015/0367210 A1 Dec. 24, 2015

(51) Int. Cl.
*A63B 59/06* (2006.01)
*A63B 71/14* (2006.01)

(52) U.S. Cl.
CPC ..... *A63B 60/06* (2015.10); *A63B 71/141* (2013.01); *A63B 59/50* (2015.10); *A63B 60/10* (2015.10); *A63B 60/14* (2015.10); *A63B 60/30* (2015.10); *A63B 2102/18* (2015.10); *A63B 2102/182* (2015.10); *A63B 2209/10* (2013.01)

(58) Field of Classification Search
CPC ..... A63B 59/0014; A63B 59/06; A63B 59/0029; A63B 59/0025; A63B 2069/008
USPC ..... 473/457, 568, 201–206, 300–303; 2/161.1, 161.2, 161.3
See application file for complete search history.

(56) References Cited

U.S. PATENT DOCUMENTS

| | | | | |
|---|---|---|---|---|
| 1,305,952 | A | 6/1919 | Suesman et al. | |
| 1,690,312 | A * | 11/1928 | Rosan | 473/206 |
| 2,225,839 | A | 12/1940 | Moore | |
| 2,471,610 | A | 5/1949 | Christensen et al. | |
| 3,624,881 | A | 12/1971 | Brown et al. | |
| 3,804,413 | A | 4/1974 | Hrivnak | |
| 3,805,413 | A | 4/1974 | Burny et al. | |
| 3,834,714 | A | 9/1974 | Smolinski | |
| 5,011,145 | A * | 4/1991 | Bartkowicz | 473/568 |
| 5,035,428 | A * | 7/1991 | Bartkowicz | 473/568 |
| 5,238,246 | A * | 8/1993 | Erb | 473/568 |
| 5,259,610 | A * | 11/1993 | Erb | 473/568 |
| 5,322,286 | A * | 6/1994 | Frost | 473/568 |
| 5,342,046 | A * | 8/1994 | Erb | 473/568 |

(Continued)

FOREIGN PATENT DOCUMENTS

| | | |
|---|---|---|
| JP | 4870310 B2 | 2/2012 |
| WO | 9317855 | 9/1993 |
| WO | 9519821 | 7/1995 |

OTHER PUBLICATIONS

USPTO, "Final Office Action", for U.S. Appl. No. 13/795,916, May 11, 2015, 5 pgs.

(Continued)

*Primary Examiner* — Mark Graham
(74) *Attorney, Agent, or Firm* — Perkins Coie LLP

(57) ABSTRACT

A sleeve or grip for use on a ball bat or other sporting-good implement includes a low-friction inner surface and a longitudinal slit that facilitates its positioning on, and removal from, a handle of the implement. The grip is rotatable about the handle so that a user's hand may move into an optimal position during a swing. The grip may be readily removable from the implement so that, after a swing, it stays with the user, as opposed to remaining on the implement.

14 Claims, 3 Drawing Sheets

(56) References Cited

U.S. PATENT DOCUMENTS

| | | | | |
|---|---|---|---|---|
| 5,482,270 | A * | 1/1996 | Smith | 473/568 |
| 5,577,722 | A | 11/1996 | Glassberg | |
| 5,588,651 | A * | 12/1996 | Frost | 473/206 |
| 5,593,158 | A | 1/1997 | Filice et al. | |
| 5,611,533 | A * | 3/1997 | Williams | 473/568 |
| 5,624,114 | A | 4/1997 | Kelsey | |
| 5,704,845 | A * | 1/1998 | Boyte | 473/205 |
| 5,839,983 | A * | 11/1998 | Kramer | 473/568 |
| 6,059,675 | A * | 5/2000 | Finn | 473/568 |
| 6,260,198 | B1 | 7/2001 | LoMedico et al. | |
| 6,277,040 | B1 * | 8/2001 | Randolph | 473/568 |
| 6,389,596 | B2 | 5/2002 | LoMedico et al. | |
| 6,406,387 | B1 | 6/2002 | Ryan et al. | |
| 6,752,731 | B1 | 6/2004 | Kramer et al. | |
| 6,799,329 | B2 | 10/2004 | LoMedico et al. | |
| 6,932,727 | B2 * | 8/2005 | Kramer | 473/568 |
| 6,996,849 | B2 | 2/2006 | LoMedico et al. | |
| 7,115,054 | B2 | 10/2006 | Giannetti et al. | |
| 7,220,195 | B1 | 5/2007 | Cronin et al. | |
| 7,484,248 | B2 | 2/2009 | Lomedico et al. | |
| 7,572,198 | B2 * | 8/2009 | Bleecker | 473/568 |
| 8,167,744 | B2 | 5/2012 | Silvain et al. | |
| 2003/0013563 | A1 | 1/2003 | Ryan et al. | |
| 2004/0048696 | A1 | 3/2004 | Ciesar et al. | |
| 2004/0224804 | A1 * | 11/2004 | Estape et al. | 473/568 |
| 2005/0272537 | A1 | 12/2005 | Kramer et al. | |
| 2008/0085792 | A1 | 4/2008 | Sims et al. | |
| 2009/0312125 | A1 * | 12/2009 | Kearns | 473/451 |
| 2012/0135826 | A1 | 5/2012 | Carlson et al. | |
| 2013/0036528 | A1 | 2/2013 | Wilson et al. | |
| 2013/0196769 | A1 | 8/2013 | Shocklee et al. | |
| 2013/0196796 | A1 | 8/2013 | Johnson et al. | |
| 2014/0274491 | A1 | 9/2014 | Long et al. | |
| 2014/0274497 | A1 | 9/2014 | Long et al. | |

OTHER PUBLICATIONS

USPTO, "International Search Report and Written Opinion", for PCT/US2014/022794, Jul. 1, 2014, 8 pgs.

USPTO, "International Search Report and Written Opinion", for PCT/US2014/022802, Jul. 1, 2014, 8 pgs.

USPTO, "Non-Final Office Action", for U.S. Appl. No. 13/795,916, Jan. 23, 2015, 6 pgs.

USPTO, "Non-Final Office Action", for U.S. Appl. No. 13/958,309, Jul. 27, 2015, 6 pgs.

USPTO, "Non-Final Office Action", for U.S. Appl. No. 13/795,916, Sep. 29, 2015, 4 pgs.

* cited by examiner

REMOVABLE, ROTATABLE GRIP ELEMENT FOR A BALL BAT OR OTHER SPORTING-GOOD IMPLEMENT

BACKGROUND

Baseball and softball batters often experience fatigue in their forearms after swinging a bat several times over a short interval. A force analysis indicates that this fatigue at least partially results from the bottom hand and the top hand opposing each other during the swing. In general, the bottom hand generally performs a pulling motion while the top hand generally performs a pushing motion. During the initial stages of the swing, as the bottom hand pulls and the top hand pushes, the barrel of the bat begins to descend into the plane of the pitched (or stationary) ball. During this time, the hands ideally rotate into the proper "power position," in which the palm of the lower hand generally faces downward while the palm of the upper hand generally faces upward. There may be some variance due to differing pitch locations but, regardless, in the power position the two palms should generally face opposite directions while being essentially coplanar. To accomplish this hand-positioning, most batters need to rotate one or both of their hands during the swing.

U.S. patent application Ser. No. 13/795,916, which was filed Mar. 12, 2013 and published Sep. 18, 2014 as U.S. Patent Application Publication No. 2014/0274497, and U.S. patent application Ser. No. 13/958,309, which was filed Aug. 2, 2013 and published Sep. 18, 2014 as U.S. Patent Application Publication No. 2014/0274491, are incorporated herein by reference and describe various ball bats in which a portion of the bat's handle is rotatable relative to the rest of the bat to facilitate positioning the batter's hands in the power position. These bat designs, however, cannot be used in Major League Baseball, or in other leagues that require the use of a one-piece, wooden bat.

SUMMARY

A sleeve or grip for use on a ball bat or other sporting-good implement includes a low-friction inner surface and a longitudinal slit that facilitates its positioning on, and removal from, a handle of the implement. The grip is rotatable about the handle so that a user's hand may move into an optimal position during a swing. The grip may be readily removable from the implement so that, after a swing, it stays with the user, as opposed to remaining on the implement. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

While the concepts described herein may be utilized in a variety of sporting-good implements, a wooden ball bat will primarily be described. It is to be understood, however, that these concepts may also be applied to non-wooden bats, as well as to lacrosse sticks or other sporting goods where hand rotation may be desirable.

Figure 1:
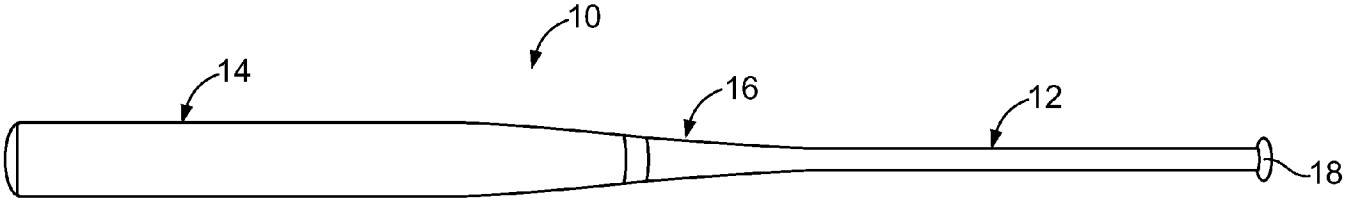
FIG. 1 is a perspective view of a ball bat, according to one embodiment.
Figure 2:
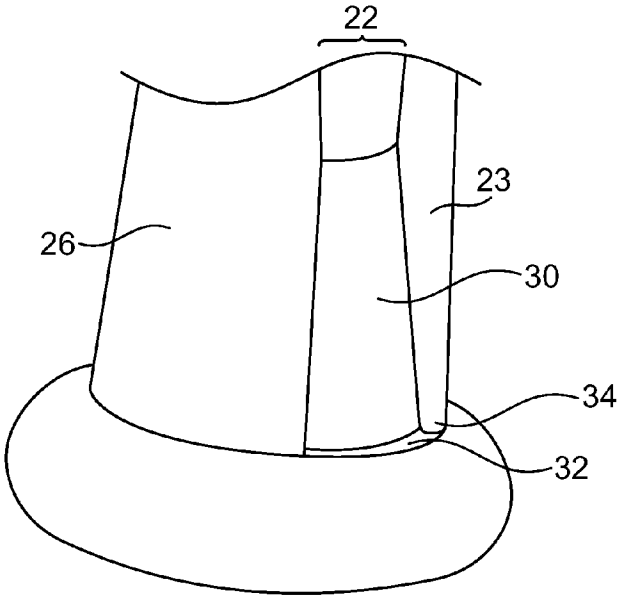
FIG. 2 is a perspective view of a bat handle including a rotatable grip element, according to one embodiment.

Turning now in detail to the drawings, as shown in FIG. 1, a baseball bat 10 includes a handle 12, a barrel 14, and a tapered section 16 joining the handle 12 to the barrel 14. The free end of the handle 12 includes a knob 18 or similar structure.

The ball bat 10 may have any suitable dimensions. For example, the ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the relevant governing association or by the user of the bat 10, and may vary between users.

As shown in FIGS. 2-5, a sleeve or grip element, or "grip" 20, includes a longitudinal slit 22 or other opening that facilitates its positioning onto the bat handle 12. The slit 22 optionally extends the entire length of the grip 20 so that the grip 20 may be opened and placed onto the bat handle 12 without having to stretch or expand the grip material around the knob 18. The grip 20 may be configured such that, once positioned on the bat 10, the edges 23 of the grip 20 defining the slit 22 return to a position near each other so that there is little or no gap between them.

In another embodiment, one or more hinged sections or gates may be included on the grip 20 at one or more of the edge regions defining the slit 22. Such a gate may be opened (via a living hinge or other hinged arrangement) to allow the grip 20 to be positioned on or removed from the bat 10, and closed over the gap created by the slit 22. In this embodiment, when a hitter finishes a swing, the hinged gate may be configured to swing open from the force of the swing so that the grip stays with the hitter.

The grip 20 may be made of a polymeric material, a thermoplastic material, a thermoset material (for example, a thermoset composite material), or another suitable material. It may be formed via injection molding, three-dimensional printing, or another suitable method.

The inner surface 24 of the grip 20 may include a low-friction material, or may be coated with such a material, so that the grip 20 may readily rotate about the bat handle 12. For example, the inner surface 24 of the grip 20 may be covered or coated with a layer of Teflon®, or with another suitable low-friction material, to facilitate rotation of the grip 20 about the handle 12. The outer surface 26 of the grip 20, conversely, may include a higher-friction material, or may be coated with such a material, so that the grip 20 is unlikely to slip out of a user's hand during swinging of the bat 10.

The grip 20 may be configured to accommodate a single hand of a user, or a portion of a hand of a user, so that only one hand of the user rotates during a swing. The grip 20, for example, may have a length of up to approximately seven inches. The grip 20 may be positioned to accommodate the user's lower hand or upper hand on the ball bat 10. If the grip 20 is positioned to accommodate the user's upper hand, a notch or groove in the ball bat 10 into which a portion of the grip 20 may be inserted or seated, or a raised projection against which the grip 20 may abut, may be included to prevent or substantially inhibit axial movement of the grip 20 during a swing. In one embodiment, multiple grips may be employed to facilitate separate rotation of both hands of a user.

In one embodiment, the bat handle's diameter increases toward the knob 18 so that the grip 20 may be positioned over the upper-handle region, then slid down toward the knob 18 to engage in a frictional fit with the larger-diameter region 30. The knob 18 prevents the grip 20 from slipping off of the end of the bat 10. If the grip 20 is positioned against the knob 18, its lower surface may include a low-friction material so that the grip 20 may rotate against the knob 18.

The knob 18 may include a circular channel or groove 32 into which a projecting portion 34 of the grip 20 may seat to aid in properly positioning the grip 20. Other configurations or features, such as a tongue-and-groove configuration, a hinged configuration, or inclusion of a magnetic pin or similar device to inhibit axial movement of the grip 20, may additionally or alternatively be used to properly position the grip 20.

Figure 5:
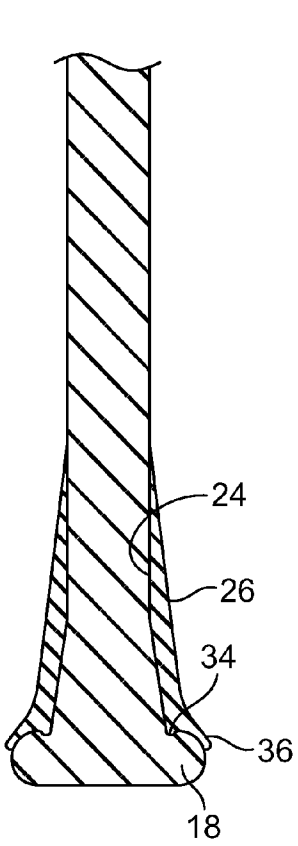
FIG. 5 is a sectional view of the bat handle of FIG. 4 taken along Section A-A.
Figure 4:
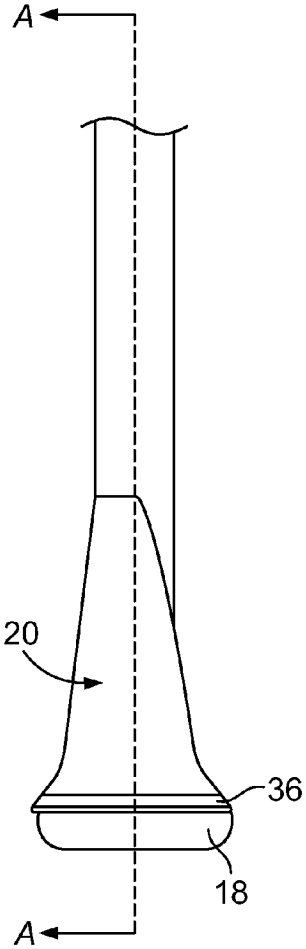
FIG. 4 is a side view of the bat handle and rotatable grip element shown in FIG. 3.
Figure 3:
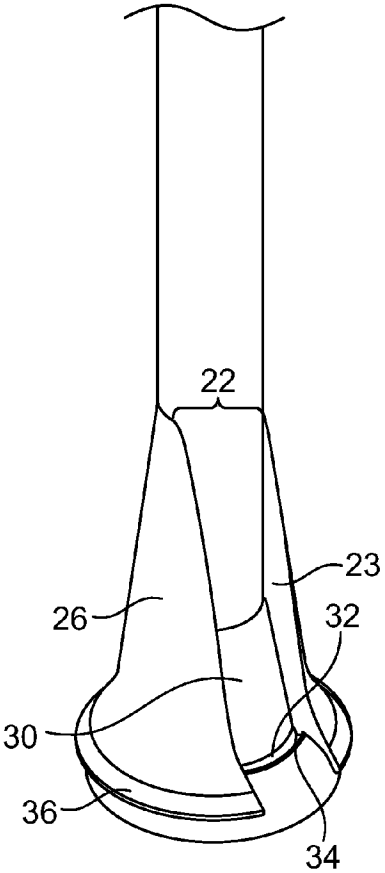
FIG. 3 is a perspective view of a bat handle including a rotatable grip element with a knob flange, according to one embodiment.

As shown in FIGS. 3-5, the grip 20 optionally includes a flange 36 configured to cover at least a portion of the knob 18 so that a user's bottom hand does not catch on the knob 18 during a swing. In some embodiments, the circumferential groove 32 in the knob 18, and the knob flange 36 on the grip 20, may be used in conjunction with each other.

Figure 6:
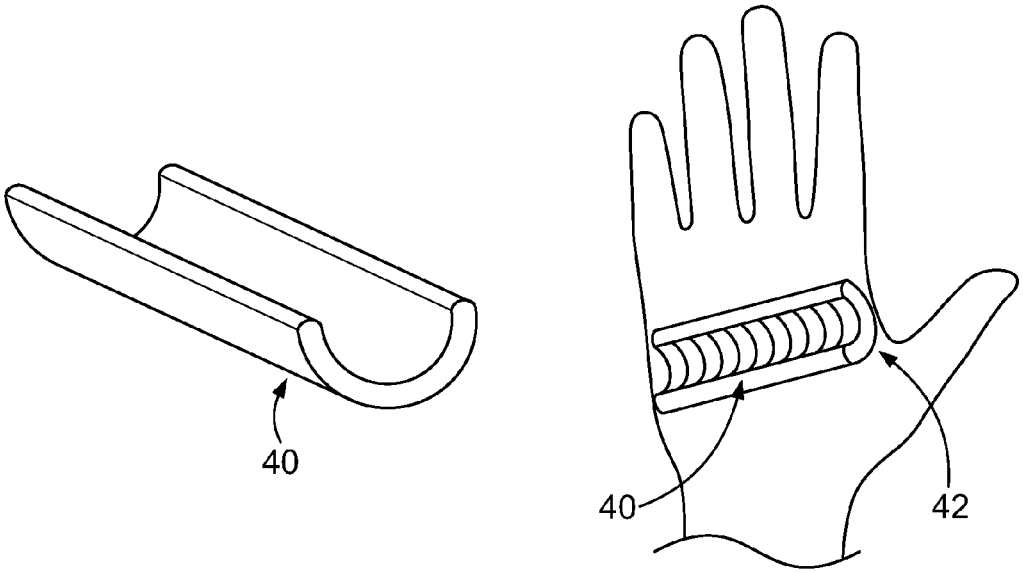
FIG. 6 is a perspective view of a batting glove attached to a low-friction grip element, according to one embodiment.

As shown in FIG. 6, in other embodiments, a partially circular or semi-circular attachment or grip 40, having a low-friction inner surface, may be attached to or positioned against a user's batting glove 42 or hand. If attached, the grip 40 may be fixed to the glove 42 via Velcro®, stitching, adhesive, or another suitable connector. The grip 40 conforms to the shape of a portion of the bat handle 12 when a user closes his or her hand around the handle 12. The low-friction inner surface of the grip 40 provides rotation of a user's hand about the handle 12 during a swing. The grip 40 may stay with the user after the swing.

Figure 7:
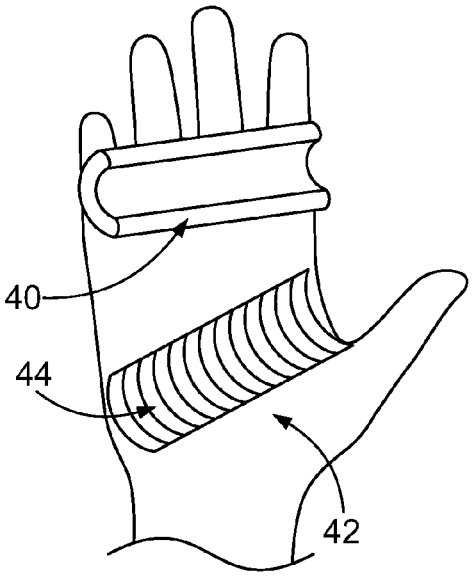
FIG. 7 is a perspective view of a batting glove including a channel and attached to a low-friction grip element, according to one embodiment.

As shown in FIG. 7, in some embodiments, the batting glove 42 may include a rounded, optionally semi-rigid, channel 44 in its palm region. The channel 44 may have a low-friction surface to facilitate rotation of the handle 12 against the channel's surface. An attachment or grip, such as the grip 40 shown in FIG. 6, may be attached to or positioned against the finger-region of the batting glove 42. When a user grips the handle 12, the channel 44 and the grip 40 provide rotational surfaces around a substantial portion of, or all of, the circumference of the handle 12.

Figure 8:
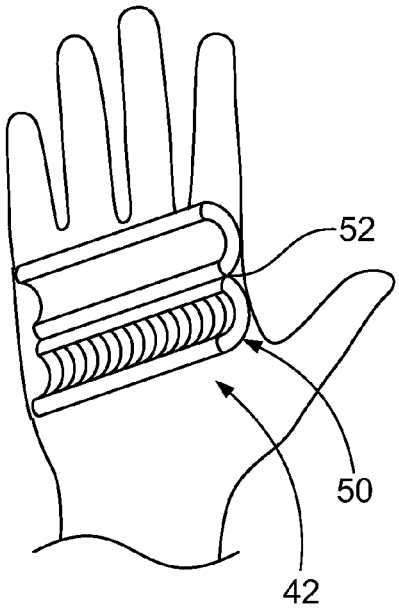
FIG. 8 is a perspective view of a batting glove attached to a hinged grip element, according to one embodiment.

As shown in FIG. 8, in some embodiments, a hinged grip 50, having a low-friction inner surface, may be attached to or positioned against a user's batting glove 42. The grip 50 includes a hinge 52 running along its length. The hinge 52 may be positioned at the base of a user's fingers or along the palm. This configuration also provides rotational surfaces around a substantial portion of, or all of, the circumference of the handle 12.

The embodiments described herein provide improved relative hand rotation for baseball and softball players. These features are particularly applicable to professional baseball or other leagues that have rules similar to those of Major League Baseball (e.g., that a one-piece wooden bat must be used). Because the rotatable grips described herein are not part of the bat itself, they provide relative hand rotation to the user without adding a permanent fixture to the bat. Indeed, the grips described herein may optionally be removed from the bat during a swing. As used herein, the term "during" is also intended to cover situations in which a hitter removes a grip from the bat immediately or shortly after completing a swing.

Any of the above-described embodiments may be used alone or in combination with one another. Furthermore, the ball bats or grips may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a handle including a proximal end and a distal end;

a barrel at the distal end of the handle; and a grip element in rotatable engagement with the handle, the grip element comprising a slit running along its length for facilitating removal of the grip element from the handle during a swing of the bat.

2. The ball bat of claim 1 wherein the ball bat is made of wood.

3. The ball bat of claim 1 wherein the grip element includes a low-friction inner surface that engages the handle.

4. The ball bat of claim 1 wherein the grip element includes a high-friction external surface.

5. The ball bat of claim 1 further comprising a knob at the proximal end of the handle, wherein a lower portion of the grip element is in rotatable engagement with the knob.

6. The ball bat of claim 5 wherein the knob includes a circular groove, and the grip element includes a projection configured to mate with the groove.

7. The ball bat of claim 5 wherein the grip element further comprises a flange configured to fit over at least a portion of the knob.

8. The ball bat of claim 1 wherein the handle includes means for preventing the grip element from slipping axially along the bat.

9. The ball bat of claim 8 wherein the means for preventing comprises a notch in the handle.

10. The ball bat of claim 8 wherein the means for preventing comprises a raised element on the handle.

11. The ball bat of claim 1 wherein the grip element further comprises a hinged section positioned opposite the slit when the grip element is positioned on the handle.

12. The ball bat of claim 1 wherein the outer diameter of the handle decreases from the proximal end of the handle toward the distal end of the handle over at least a portion of the length of the handle, and wherein the grip element is positioned over the proximal end of the handle.

13. A ball bat, comprising:

a handle including a proximal end and a distal end;

a barrel at the distal end of the handle;

a knob at the proximal end of the handle, the knob including a circular groove;

a grip element in rotatable engagement with the handle, the grip element including a projection mating with the groove.

14. The ball bat of claim 13 wherein the grip element comprises an opening along its length that facilitates removal of the grip element from the handle during a swing.

* * * * *